US006640391B2

(12) United States Patent
Breuer et al.

(10) Patent No.: US 6,640,391 B2
(45) Date of Patent: Nov. 4, 2003

(54) PRESSURE REGULATING DEVICE FOR USE ON A CARDING MACHINE

(75) Inventors: Joachim Breuer, Aachen (DE); Christoph Färber, Korschenbroich (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/215,039

(22) Filed: Aug. 9, 2002

(65) Prior Publication Data

US 2003/0029003 A1 Feb. 13, 2003

(30) Foreign Application Priority Data

Aug. 9, 2001 (DE) ..... 101 39 163

(51) Int. Cl.[7] ..... D01G 15/82
(52) U.S. Cl. ..... 19/98; 19/107; 19/109
(58) Field of Search ..... 19/65 A, 98, 104, 19/105, 107, 108, 109, 110, 113, 205, 200

(56) References Cited

U.S. PATENT DOCUMENTS

| | | | | |
|---|---|---|---|---|
| 4,309,796 A | | 1/1982 | Garrison et al. | |
| 4,982,478 A | * | 1/1991 | Stahli et al. | 19/102 |
| 5,031,279 A | * | 7/1991 | Temburg | 19/104 |
| 5,075,930 A | * | 12/1991 | Carey et al. | 19/104 |
| 5,144,723 A | | 9/1992 | Hohloch et al. | |
| 5,241,726 A | * | 9/1993 | Pezzoli et al. | 19/200 |
| 5,255,415 A | * | 10/1993 | Leifeld et al. | 19/107 |
| 5,530,994 A | * | 7/1996 | Loeffler | 19/109 |
| 6,138,326 A | | 10/2000 | Pinto | 19/104 |
| 6,145,166 A | * | 11/2000 | Waeber et al. | 19/109 |

FOREIGN PATENT DOCUMENTS

| | | |
|---|---|---|
| DE | 38 35 776 | 4/1990 |
| DE | 691 21 314 T2 | 12/1991 |
| DE | 298 10 964 U1 | 6/1998 |
| DE | 199 25 506 A1 | 12/2000 |
| EP | 0 608 686 A1 | 8/1994 |
| EP | 0 848 091 A1 | 6/1998 |
| GB | 1 483 291 | 8/1977 |
| GB | 2 228 495 A | 8/1990 |

* cited by examiner

*Primary Examiner*—Gary L. Welch
(74) *Attorney, Agent, or Firm*—Venable, LLP; Robert Kinberg; Stuart I. Smith

(57) ABSTRACT

A pressure control system is provided for use with a carding machine having a carding cylinder with clothing. The pressure control system has a cover for positioning opposite the carding cylinder clothing, an opening in the cover for separating foreign particles from desirable fibers, and a replaceable pressure regulator mounted in the cover. The pressure regulator is for adjusting a pressure between the cover and the carding cylinder.

18 Claims, 3 Drawing Sheets

PRESSURE REGULATING DEVICE FOR USE ON A CARDING MACHINE

CROSS-REFERENCE TO RELATED APPLICATION

This application claims priority to German Patent Application No. 101 39 163.3 filed on Aug. 9, 2001, the disclosure of which is incorporated herein by reference.

BACKGROUND OF THE INVENTION

The invention relates to fiber carding machines. More particularly, the invention relates to a device on a carding machine. The device has cover elements with openings arranged opposite the main carding cylinder clothing for separating out foreign particles such as trash, seed parts, leaf rests and the like through the openings.

A known device of this type, disclosed in German patent document DE 38 35 776, has a cleaning apparatus in the form of a suction unit, with a guide rod arranged in front and a cutter bar arranged behind the unit. The disadvantage of this device is that adjustments cannot be made to influence the composition of the waste material containing foreign particles that is separated out.

SUMMARY OF THE INVENTION

It is an object of the invention to create a device which avoids the aforementioned disadvantages and, in particular, makes it possible to change or influence the waste material composition and to adjust the waste material separation.

Particular embodiments of the invention provide a pressure control system for use with a carding machine having a carding cylinder with clothing. The pressure control system has a cover for positioning opposite the carding cylinder clothing, an opening in the cover for separating foreign particles from desirable fibers, and a replaceable pressure regulator mounted in the cover. The pressure regulator is for adjusting a pressure between the cover and the carding cylinder.

The composition of the waste leaving through the separation opening can be changed or influenced and an adjustment of the waste material separation can be made through adjusting the pressure between the cover and the main carding cylinder. One advantage is the optimization of the waste material separation, which improves the ratio between desired separation of foreign particles and undesirable removal of good fibers. In addition, the waste material separation can be better adapted to the fiber material (raw material) to be processed.

Embodiments of the invention provide a changeable element of a cover that is opposite the clothing of a carding cylinder. The cover element can be a throttle bar, wherein the distance between the throttle bar and the clothing can preferably be changed. It is advantageous if the pressure, as seen in rotational direction of the cylinder, is increased in front of the throttle bar and is reduced behind the throttle bar. The cover element can also be a fixed carding element with clothing. The distance between the clothing on the fixed carding element and the clothing on the main carding cylinder should be changeable. It is advantageous if the pressure, as seen in the rotational direction of the main carding cylinder, is increased in front of the fixed carding element and is reduced behind the fixed carding element. The cover element can also have an air flow opening, wherein the air flow opening preferably can be connected to a vacuum and/or compressed air source. The strength of this vacuum and/or compressed air source should be adjustable. It is advantageous if the size of the air flow opening can be changed, wherein the size of the opening can be advantageously used for realizing a pressure drop (in the case of excess pressure) or a pressure increase (in the case of low pressure).

Other embodiments of the invention provide a carding machine having a carding cylinder having clothing, and a pressure control system. The pressure control system has a cover for positioning opposite the carding cylinder clothing, an opening in the cover for separating foreign particles from desirable fibers, and a replaceable pressure regulator mounted in the cover. The pressure regulator adjusts a pressure between the cover and the carding cylinder.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
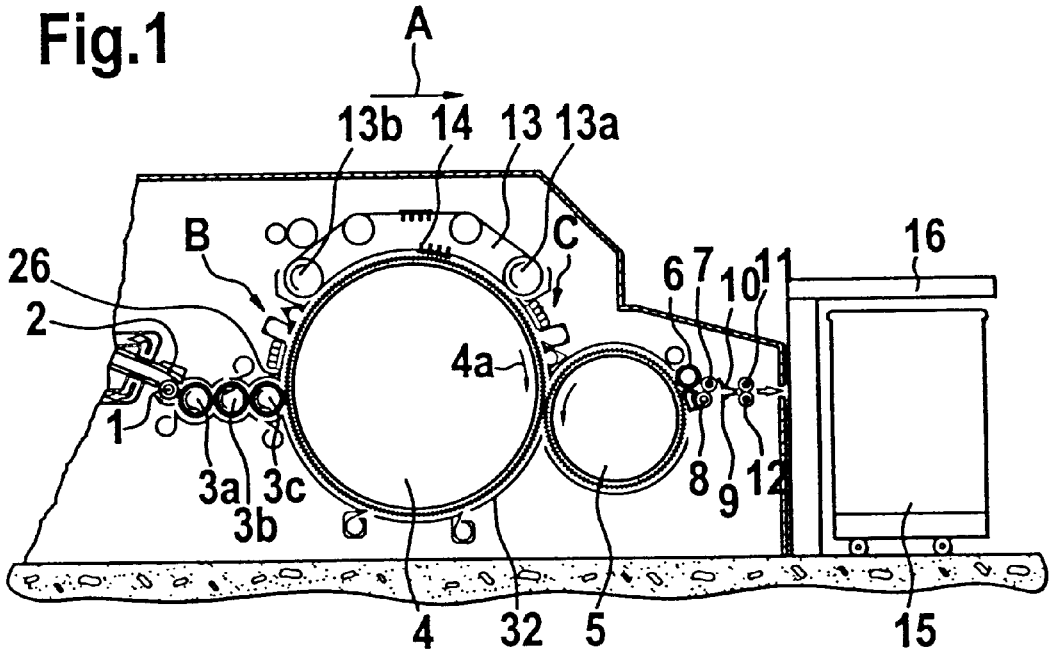
FIG. 1 is a side elevation view of a carding machine provided with a device in accordance with the invention.

FIG. 1 shows a carding machine, for example a Trützschler high performance carding machine Model DK 903, having a feed roller 1, a feed table 2, licker-ins 3*a*, 3*b*, 3*c*, main carding cylinder 4, doffer 5, stripping roller 6, crushing rollers 7, 8, sliver guide element 9, web trumpet 10, withdrawing rollers 11, 12, traveling flats 13 with flat bars 14, can 15 and can holder 16. Main carding cylinder 4 is substantially enclosed within shroud 32. Traveling flats 13 travel around rollers 13*a* and 13*b*. The curved arrows indicate the rotational direction of the rollers, while arrow A shows the operating direction. A device according to the invention can be arranged, for example, at locations B and/or C on the main carding cylinder 4.

Figure 1A:
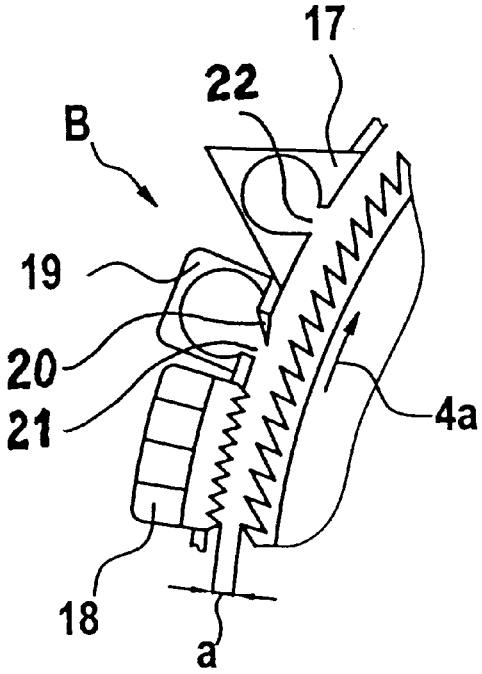
FIG. 1*a* shows a portion of an embodiment of the device with an opening at a first location B on the cylinder.
Figure 1B:
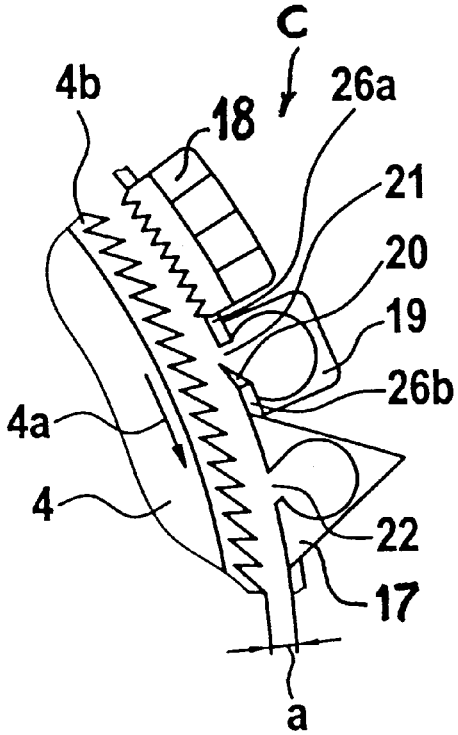
FIG. 1*b* shows the embodiment shown in FIG. 1*a*, but at a different location C on the main carding cylinder.

Referring now to FIG. 1*a*, a fixed carding element 18, a suction hood 19 with separating knife 20 and separation opening 21, and a pressure manipulator 17 with opening 22 are provided at location B. The rotational direction of the main carding cylinder 4 is designated as 4*a*. FIG. 1*b* shows a fixed carding element 18, a suction hood 19 and a pressure manipulator 17 (with opening 22) arranged one behind the other in the rotational direction 4*a* of the main carding cylinder 4 at location C. The reference 4*b* applies to the cylinder clothing while 26 (FIG. 1), 26*a* and 26*b* (FIG. 1*b*) apply to the cover that is located opposite the clothing 4*b*.

Figure 2A:
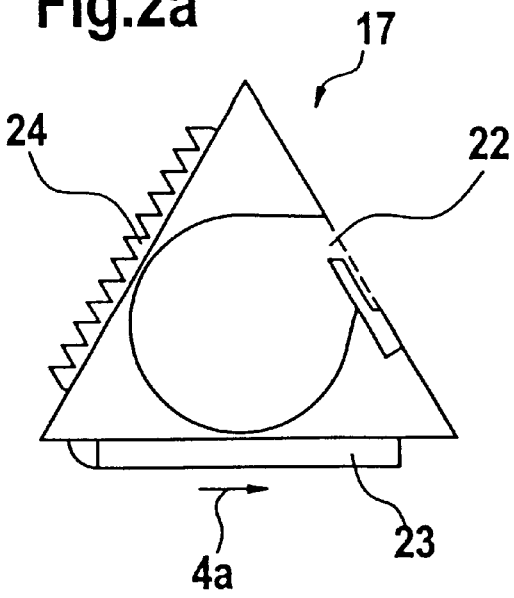
FIGS. 2*a*–2*c* show three positions of a replaceable element in accordance with the invention.
Figure 2B:
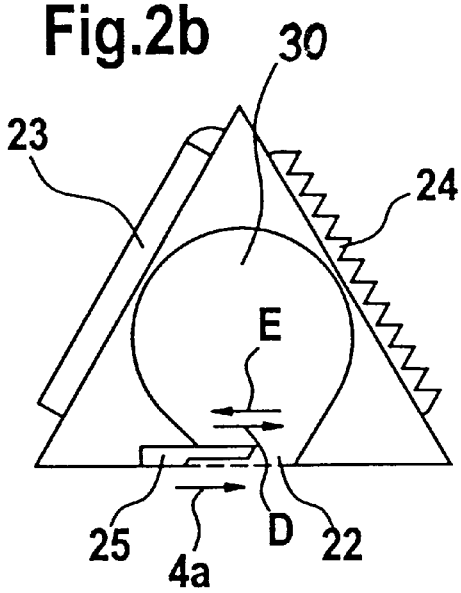
Figure 2C:
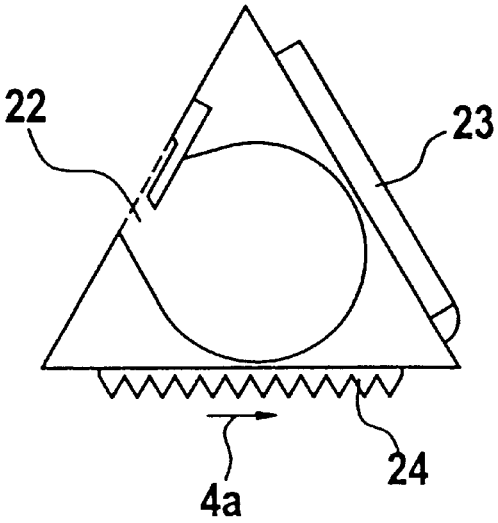

In accordance with FIGS. 2*a* to 2*c*, a throttle bar 23, a fixed clothing 24 and an opening 22 are arranged jointly on a replaceable, rotatable pressure manipulator 17. In FIG. 2*a*, pressure manipulator 17 is in the position that places throttle bar 23 in the use position, meaning it is arranged opposite the main carding cylinder clothing 4*b* (see FIGS. 1*a*, 1*b*). In this position, the opening 22 and the fixed clothing 24 are in non-use positions. In FIG. 2*b*, the opening 22 is in the use position, meaning it is arranged opposite the main carding cylinder clothing 4*b*. A slide 25 that can be moved in the direction of arrows D, E can be used to change the width of opening 22. A hood chamber 30 is assigned to the opening 22, which can be connected to an adjustable suction or compressed air source (not shown herein) or to the atmospheric air. In FIG. 2*c*, the fixed clothing 24 is in use, meaning it is arranged opposite the main carding cylinder clothing 4*b*, whereas the opening 22 and the throttle bar 23 are in the non-use positions. The distance "a" (shown in FIGS. 1*a* and 1*b*) of elements 22, 23 and 24 to the opposite-arranged main carding cylinder clothing 4*b* can be adjusted (in a manner not shown herein).

Figure 3:
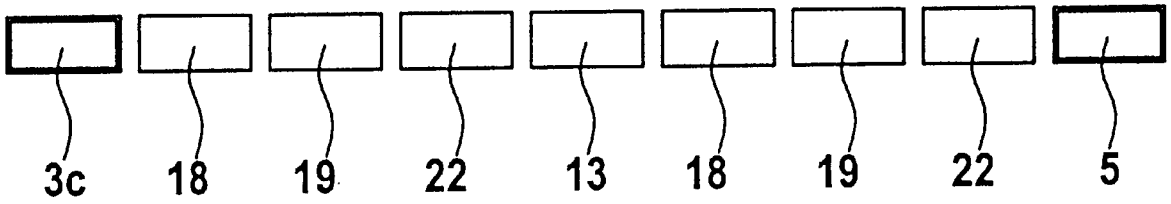
FIG. 3 shows a diagram illustrating an example of an arrangement including embodiments of the invention.

The block diagram in FIG. 3 shows the arrangement of two elements according to the invention, one including an opening 22 in region B between licker-in 3*c* and traveling flats 13, and another including the opening 22 in region C between traveling flats 13 and doffer 5 of the carding machine. The openings 22 follow the carding elements 18 and the hoods 19, respectively.

Figure 4:
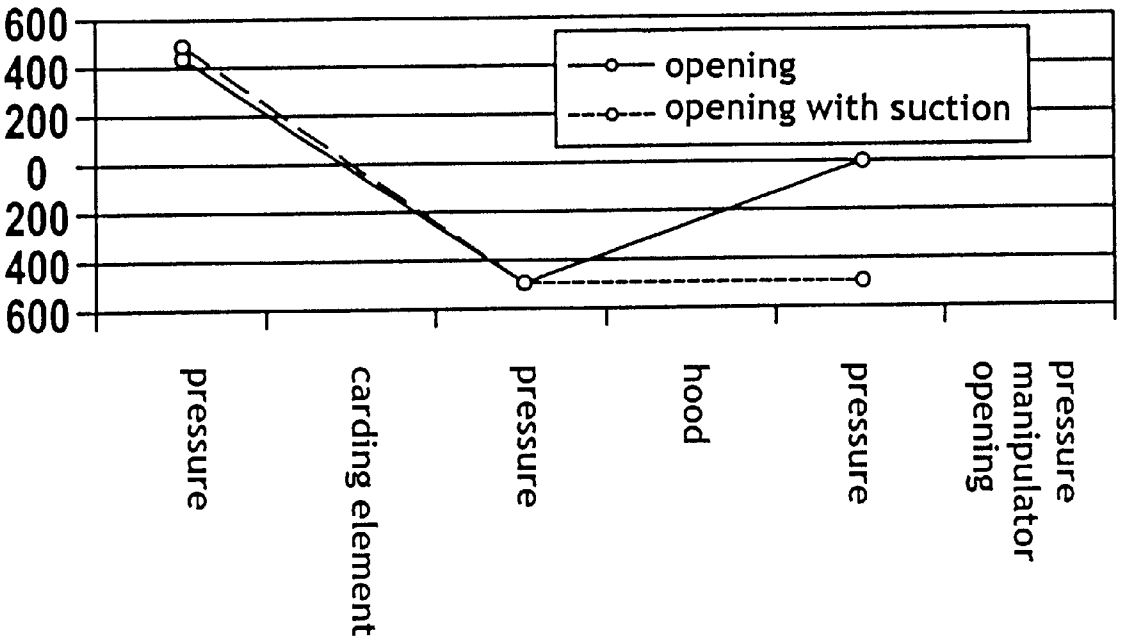
FIG. 4 shows an exemplary pressure curve when using the device according to the invention.

If a fixed carding element 18 is arranged in front of the suction hood 19, the pressure between cover 26 and main carding cylinder 4 drops in accordance with FIG. 4. If suction is applied to the downstream arranged opening 22, the pressure remains the same. If no suction is applied to the opening 22, the pressure increases again.

The carding machine is of primary importance for the cleaning of fibers in the spinning factory. The term cleaning frequently refers to the degree of cleaning, meaning the degree of trash separation. When applied to a high yarn quality, this term refers to interfering particles such as dust, fiber fragments, trash parts, neps and husk burls. Suction hoods 19, also known as "webcleans," are used for this in addition to the traveling flats 13. However, the composition of the separated out particles cannot be influenced by adapting the geometry, such as the gap opening and the knife position.

The invention allows the waste material separation to be optimized for a specific raw material.

A separation unit consists of a hood and additional optional elements arranged around the hood. Several separation units can be installed one behind the other. For example, a separation unit can have a fixed carding element and a hood (a suction location with a knife). The suction hood is an important element of a separation unit. Additional elements are positioned around the suction hood. The separation behavior of the hood can be influenced to a high degree by the selection of the elements to be installed around the hood.

Far-reaching differences in the waste composition can be achieved as a result of adapting the positioning of the elements in front of and behind the suction hood. Some of the differences resulting from changing the positioning of the elements are increased nep separation, an increase in the amount of waste material that is separated out, increased waste material separation, and an increase in the fiber opening (break-up), etc.

The pressures in front of and behind the suction hood can be different, depending on the positioning of the elements. These pressures are responsible for the amount and composition of the separated out waste material.

Connecting several separation units one behind the other would result in each of the units having a similar effect on the material, thus preventing the units from reaching their full potential. Suitable points of intersection from one separation unit to the next should be created to prevent this inefficiency. To this end, the pressure manipulator 17 according to the invention contains three different operational elements on its surface. Carding element 24 serves to open up the fiber floccule and to build up or reduce the pressure behind the pressure manipulator 17. Throttle bar 23 reduces the cross-sectional area of the passage, and is used to build up or reduce the pressure in front of or behind the pressure manipulator 17. Opening 22 causes a drop in pressure (in the case of excess pressure) or an increase in pressure (in the case of low pressure), by allowing air to flow in or out.

A different pressure level exists at the main carding cylinder 4, depending on which surface of the pressure manipulator 17 is in the use position and, therefore, fits against the flexible bend of the carding machine. By integrating the pressure manipulator 17 into the separation unit, different separation units can be installed with the highest flexibility one behind the other in the smallest possible space. By lining up the separation units, the separation effects can be increased through repetition of the components or different separation effects can be achieved one after another.

Thus, a pressure manipulator 17 is added to a separation unit consisting of a carding element and a suction hood.

Several functions are integrated in the special profiles of the pressure manipulator, one of which functions can be selectively activated. The profile switches the function of the pressure manipulator 17 between a carding element 24 (clothing), a narrow pass 23 (throttle bar), and an opening 22.

The pressure manipulator 17 can be attached with screws to one of three sides on the flexible bend and can also be connected to an air movement system, if desired, depending on whether air must be fed in or exhausted. The distance between the pressure manipulator 17 and the clothing (distance a) can be adjusted. The distance a of the pressure manipulator 17, and thus the narrow pass and the carding bar, can be changed mechanically or with the aid of a motor. Such an adjustment mechanism can be integrated into a control circuit of the carding machine having quality sensors as measuring variables. In addition, the size of the opening 22 in the pressure manipulator 17 can be changed. Finally, the amount of air flowing in or out of the opening 22 can be changed mechanically or with a motor. Such an adjustment mechanism can be integrated into the control circuit for the carding machine.

The individual parts such as the suction hood 19, fixed carding element 18 and pressure manipulator 17 are combined to form a single separation unit. Each separation unit is viewed as an independent unit. The fixed carding element 18, hood 19 with knife 20, and pressure manipulator 17 permit an optional modular design because these elements have the same base width. The manner in which the elements are positioned around the hood 19 determines the separation effect. Each arrangement of elements has a specific separation effect. The separation effects can be increased or different types of separation effects can be activated successively with the respective separation units.

The pressure for the device according to the invention is manipulated with the aid of a throttle bar 23 with a narrow pass, such as, for example, a flat iron bar across the frame width. A narrow pass of this type can be adjusted very close to the main carding cylinder clothing 4*b*, thus changing the pressure upstream and downstream considerably without carding of the material. The pressure can also be manipulated with openings 22, wherein the opening 22 is adjusted to prevent fiber material from escaping. Air can escape through the openings 22 in case of excess pressure and air can be sucked in with low pressure, so that the pressure behind the opening is nearly zero.

In addition, these special opening locations make it possible to actively suck air out so that low pressure is created downstream and upstream. In the same way, air can be blown in purposely through these openings to create excess pressure.

The size of the opening 22 can be adjusted (see FIG. 2*b*), thus making it possible to adjust the amount of air that is exchanged.

By combining the pressure manipulator 17 with suction hoods 19 and, if necessary, carding elements 18, it is possible to greatly change the composition of the separated out material at the suction hoods 19. That is to say, a large amount of waste can be separated out with one combination while many neps can be removed with a different type of combination.

It is advantageous that air is purposely and actively suctioned off at the pressure manipulator 17, so that the pressure at the roller can be reduced further or air can be actively fed in.

The pressure manipulator 17, including the new operating elements, e.g., the openings 22 and the narrow pass provided by the throttle bar 23, can be used in conjunction with all rotating and clothing-covered rollers such as the main carding cylinder 4.

By integrating the pressure manipulator 17, in particular the opening locations, the separation units consisting of carding elements 18 and hoods 19 can be connected in series one behind the other with the same effect.

The invention has been described in detail with respect to preferred embodiments. It will be apparent from the foregoing to those skilled in the art, that changes and modifications may be made without departing from the invention in its broader aspects, and the invention, therefore, is intended to cover all such changes and modifications that fall within the true spirit of the invention.

What is claimed is:

1. A pressure control system for use with a carding machine having a carding cylinder, the carding cylinder having clothing and a rotational direction, the pressure control system comprising:

a cover for positioning opposite the carding cylinder clothing;

an opening in the cover for separating foreign particles from desirable fibers; and a replaceable pressure regulator mounted in the cover and having a throttle bar, a fixed carding element with clothing, and an air flow opening, the replaceable pressure regulator being positionable in the carding machine in a plurality of different orientations, wherein the pressure regulator is for adjusting a pressure between the cover and the carding cylinder.

2. The system of claim 1, wherein, with respect to the rotational direction of the carding cylinder, the opening is located upstream of the pressure regulator.

3. The system of claim 1, wherein, with respect to the rotational direction of the carding cylinder, the opening is located downstream of the pressure regulator.

4. The system of claim 1, wherein a distance between the throttle bar and the carding cylinder clothing is adjustable.

5. The system of claim 1, wherein, with respect to the rotational direction of the carding cylinder, the pressure increases upstream of the throttle bar and decreases downstream of the throttle bar.

6. The system of claim 1 wherein the pressure regulator comprises a fixed carding element with clothing.

7. The system of claim 6, wherein a distance between the clothing on the fixed carding element and the clothing on the carding cylinder is adjustable.

8. The system of claim 6, wherein, with respect to the rotational direction of the carding cylinder, the pressure increases upstream of the fixed carding element and decreases downstream of the fixed carding element.

9. The system of claim 1, wherein the air flow opening is for connecting to one of a suction air source and a compressed air source.

10. The system of claim 9, wherein a pressure of the air source is adjustable.

11. The system of claim 1, wherein a size of the air flow opening is adjustable.

12. The system of claim 1, wherein one of the throttle bar, the fixed carding element with clothing, and the air flow opening is in an in-use position while the other two of the throttle bar, the fixed carding element with clothing, and the air flow opening are in non-use positions.

13. A pressure control system for use with a carding machine having a carding cylinder, the carding cylinder having clothing, the pressure control system comprising:

a cover for positioning opposite the carding cylinder clothing;

an opening in the cover for separating foreign particles from desirable fibers;

a replaceable pressure regulator mounted in the cover, the pressure regulator comprising an air flow opening having an adjustable size; and means for adjusting the size of the air flow opening to a first size when the pressure between the cover and the carding cylinder is above a first predetermined pressure, and to a second size when the pressure between the cover and the carding cylinder is below a second predetermined pressure, wherein the pressure regulator is for adjusting a pressure between the cover and the carding cylinder.

14. A pressure control system for use with a carding machine having a carding cylinder, the carding cylinder having clothing, the pressure control system comprising:

a cover for positioning opposite the carding cylinder clothing;

an opening in the cover for separating foreign particles from desirable fibers; and a replaceable pressure regulator mounted in the cover, the pressure regulator being positionable in the carding machine in a plurality of different orientations, wherein the pressure regulator is for adjusting a pressure between the cover and the carding cylinder, and the replaceable pressure regulator is generally triangular in shape and each one of the throttle bar, the fixed carding element with clothing, and the air flow opening occupies a different side of the replaceable pressure regulator.

15. A carding machine comprising:

a carding cylinder having clothing; and a pressure control system having a cover positioned opposite the carding cylinder clothing;

an opening in the cover for separating foreign particles from desirable fibers; and a replaceable pressure regulator mounted in the cover and having a throttle bar, a fixed carding element with clothing, and an air flow opening, the replaceable pressure regulator being positionable in the carding machine in a plurality of different orientations, wherein the pressure regulator adjusts a pressure between the cover and the carding cylinder.

16. The carding machine of claim 15, wherein one of the throttle bar, the fixed carding element with clothing, and the air flow opening is in an in-use position while the other two of the throttle bar, the fixed carding element with clothing, and the air flow opening are in non-use positions.

17. The carding machine of claim 15, further comprising a second pressure control system, the second pressure control system having a second cover positioned opposite the carding cylinder clothing;

an opening in the second cover for separating foreign particles from desirable fibers; and a second replaceable pressure regulator mounted in the second cover, wherein the second pressure regulator adjusts a pressure between the second cover and the carding cylinder.

18. A carding machine comprising:

a carding cylinder having clothing; and a pressure control system having a cover positioned opposite the carding cylinder clothing;

an opening in the cover for separating foreign particles from desirable fibers; and a replaceable pressure regulator mounted in the cover, the pressure regulator being positionable in the carding machine in a plurality of different orientations, wherein the pressure regulator adjusts a pressure between the cover and the carding cylinder, and the replaceable pressure regulator is generally triangular in shape and each one of the throttle bar, the fixed carding element with clothing, and the air flow opening occupies a different side of the replaceable pressure regulator.

* * * * *